United States Patent [19]

Mason

[11] 4,043,134

[45] Aug. 23, 1977

[54] GUIDE ARM CLAMP MECHANISM FOR SUBMERGIBLE CHAMBER

[76] Inventor: Burton Hoster Mason, Box 54, Covington, La. 70433

[21] Appl. No.: 686,088

[22] Filed: May 13, 1976

[51] Int. Cl.[2] ..... B63C 11/40

[52] U.S. Cl. ..... 61/69 R; 61/63; 335/285

[58] Field of Search ..... 61/69 R, 63; 335/285, 335/286, 289, 290, 291, 294, 295; 214/1 CM; 114/16 R, 50, 51

[56] References Cited

U.S. PATENT DOCUMENTS

| | | | |
|---|---|---|---|
| 2,104,062 | 1/1938 | Temple | 335/294 |
| 2,421,716 | 6/1947 | Rose | 335/295 X |
| 3,409,854 | 11/1968 | Swallert | 335/289 |
| 3,698,197 | 10/1972 | Bodey et al. | 61/69 R X |
| 3,851,491 | 12/1974 | Mason | 61/69 R |

*Primary Examiner*—Dennis L. Taylor
*Attorney, Agent, or Firm*—Marvin Feldman; Stephen E. Feldman

[57] ABSTRACT

A submergible chamber is provided with flanges at the outward ends of chamber guide arms, wherein each flange engages a stanchion. In one embodiment the flanges are selectively electromagnetic with the stanchions, and with sufficient force, the flanges are held to the stanchions thereby positioning the chamber at a specific depth. In another embodiment, the flange is adapted to pivotally grip the stanchion, and further each stanchion is provided with a vertical gear rack engaging the driven gear of each respective work arm so as to accurately position the chamber at a specific depth whereat the clamp holds the chamber at that depth.

16 Claims, 8 Drawing Figures

GUIDE ARM CLAMP MECHANISM FOR SUBMERGIBLE CHAMBER

This invention relates to guide arm clamps for a submergible chamber. Specifically this invention relates to submergible chamber clamps for engaging underwater stanchions so as to hold the chamber at a desired depth.

In Mason, U.S. Pat. No. 3,851,491, issued Dec. 3, 1974, there is disclosed a submergible chamber having a pair of outwardly extending guide arms with a guide wire clamp disposed at the outward end of each arm. Each clamp would slide along the wire with the positive or negative bouyant movement of the chamber, and the clamp would then be actuated to grip the wire so as to hold the chamber at a desired depth.

While such prior art devices served their intended functions, the use of guide wires presented problems in that generally the clamp would have to first engage the wire at the surface, and further at great depths the several hundred feet of wire were thought to encumber the subsea operations. Still further, safety wire cutters were considered to ensure release from a wire possibly entangling the guide arms.

Now there is provided by the present invention a guide arm clamp for a submergible chamber wherein the use of guide wires is eliminated, and where there is positive and accurate positioning of the chamber at a desired depth.

It is therefore an object of this invention to provide submergible chamber guide arm clamps for engaging underwater stanchions.

It is another object of this invention to provide clamps as aforesaid wherein electromagnetic forces hold the clamps relative to respective stanchions.

It is still another object of this invention to provide electromagnetic guide arm clamps wherein the electromagnetic force is controllable to permit either movable or fixed disposition with the stanchions.

It is another object of this invention to provide submergible chamber guide arm clamps, wherein with the clamps in a movable disposition with underwater stations, there is further provided means to provide motion between the clamps and the respective stanchions.

It is still a further object of this invention to provide guide arm clamps as aforesaid, wherein said clamp may be aligned with subsea stanchions.

It is still a further object of this invention to provide an apparatus as aforesaid wherein the guide arm clamps are readily and safely disconnectable from the stanchions, so as to facilitate a safe ascent of said chambered portion.

Another object of this invention is to provide a method and apparatus which is safe and practical for employing at subsea locations and yet such apparatus is readily fabricated and of relatively inexpensive construction and practical in design and operation.

Further objects and advantages of the present invention will become apparent from the following description and the accompanying drawings which illustrate certain presently preferred embodiments of the invention and wherein.

Figure 1:
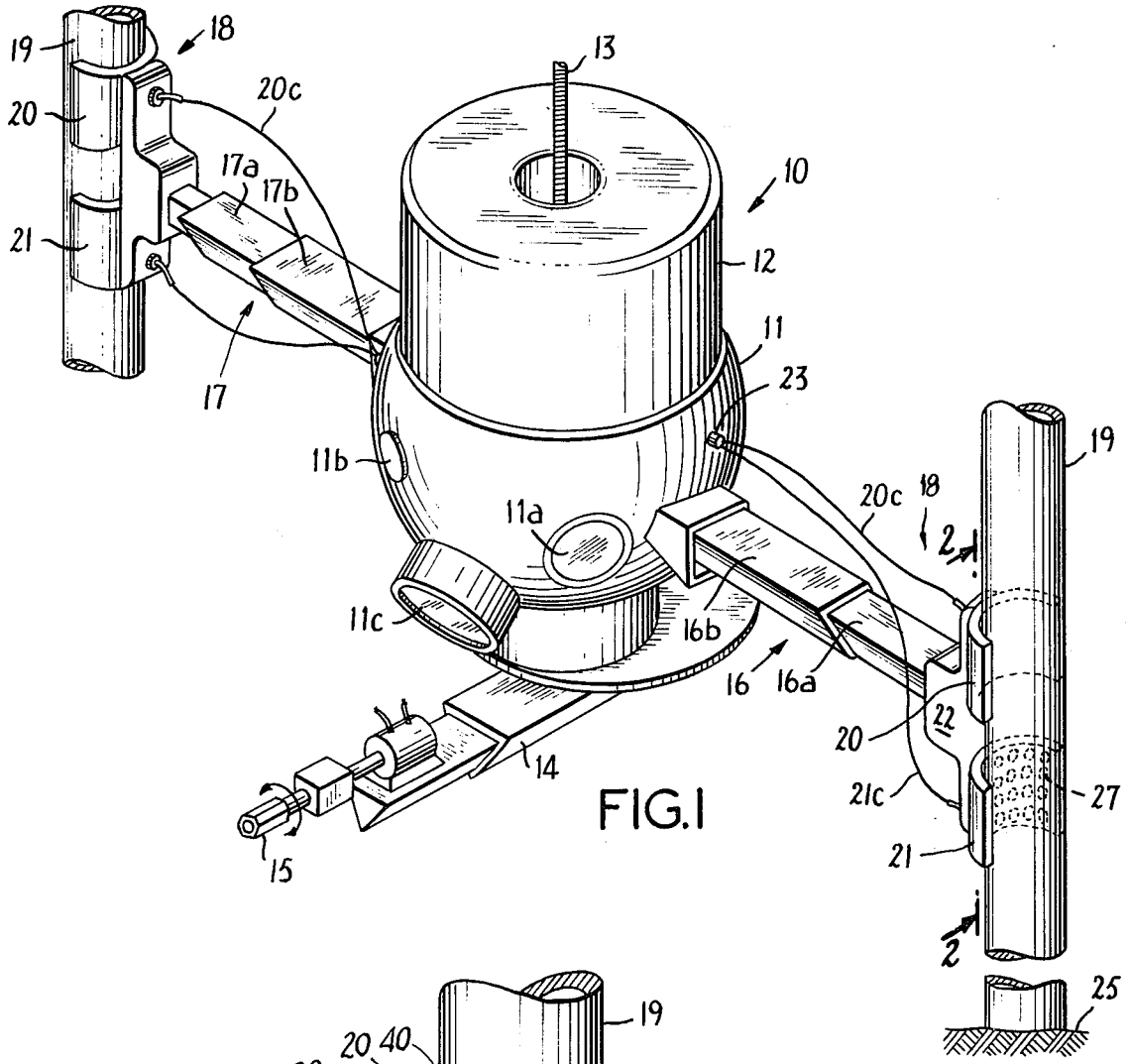
FIG. 1 is a perspective view of a submerged chamber having guide arm clamps embodying the present invention.
Figure 2:
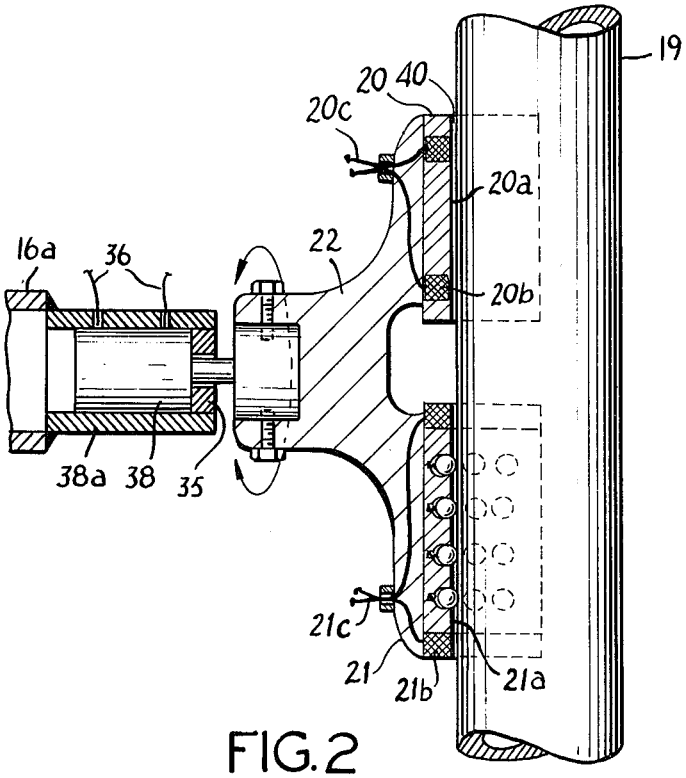
FIG. 2 is an enlarged partial sectional view taken along line 2—2 of FIG. 1.
Figure 3:
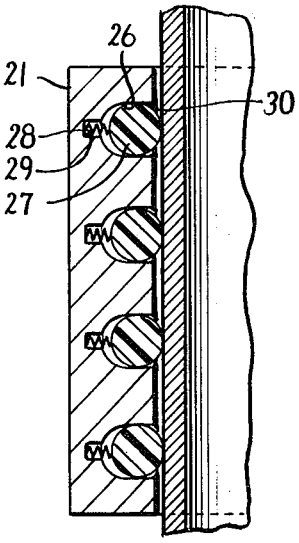
FIG. 3 is an enlarged partial view of the ball roller assembly shown in FIG. 2, but in the fully clamped mode.

Referring to FIGS. 1–3, there is shown a submergible chamber 10 comprising a chamber body 11 with view ports 11a, 11b and 11c, a bouyancy tank 12, a surface-connected lift wire 13, a work arm 14 and work tool 15, a pair of guide arms 16 and 17 and similar guide arm clamp mechanisms according to the present invention, generally designated as 18, mounted to each guide arm. Each clamp mechanism is attached to a stanchion 19.

Guide arms 16 and 17 comprise retractably extensible outward portions **16*a* and 17*a*, respectively, which are received in arm portions 16*a* and 17*a*, respectively, which are received in arm portions 16*b* and 17*b*, respectively. Portions 16*a*, 17*a*** may be actuated by means (not shown) from within the chamber, and may further comprise ram extension mechanisms as set forth in U.S. Pat. No. 3,851,491, issued Dec. 3, 1974.

The present invention is principally directed to guide arm clamp mechanism 18, and other preferred embodiments as will be described hereinafter.

Clamp 18, comprises two semi-cylindrical flanges 20 and 21 being in parallel axial disposition, and being joined to a common body member 22. Each flange 20 and 21 comprises a semi-cylindrical surface **20*a* and 21*a*, respectively, which surfaces are in facing opposition to the cylindrical surface of metal stanchion 19. Stanchion 19 is fixedly secured to the sea bed at 25 so as to be held in a vertical upright disposition. Each flange 20 and 21 further comprises an electromagnetic coil 20*b* and 21*b*, respectively, which coil when actuated creates an electromagnetic force of attraction between the respective flanges and the metal stanchion 19. Coil 20*b* is connected by connection 23 to actuation means within the chamber body by electrical conduits 20*c*, and coil 21*b* is connected to similar actuation means within the chamber body by electrical conduits 21*c***.

Flange 21 is formed with a plurality of sockets 26, each being provided with a Teflon ball 27 and a compression spring 28 mounted between ball 27 and recess 29 (typical). Socket 26 is formed with a circumferential lip 30, of lesser diameter than ball 27 so as to retain ball 27 in socket 26 under the influence of spring 28. In this manner of construction, each ball 27, in the non-clamping mode, extends outwardly past the flange surface **21*a* (FIG. 2), and in the clamping mode each ball 27 is fully disposed in socket 26 (FIG. 3). The balls 27** may be of Nylon or Teflon surface construction.

Housing 22 is formed with a central recess 31 for receiving flange 32 which is fixedly secured within recess 31 by bolts 33 (typical). Flange 32 is fixedly mounted to rotary shaft 34 which is rotatably mounted to low rpm drive motor 35. Drive motor 35 is housed in connecting section **35*a* which also houses bushing 35*b*, and motor 35 is electrically interconnected by 36** to the chamber so as to be operable from within the chamber.

Section 35*a* is fixedly secured to retractably extensible arm portion 16*a*. With the actuation of motor 35, flanges 20 and 21 are simultaneously angularly disposed, so as to permit the flanges 30 and 21 to be aligned properly with the stanchion. This is often necessary as the stanchion axis may not be parallel to the chamber axis.

In operation, the chamber is lowered and bouyancy tank 12 permits the descent of the chamber to a subsea station whereat stanchions 19 have been fixedly installed with the desired spacing to accomodate arms 16 and 17. With the descent of chamber 10, arms 16 and 17 are moved and motor 35 actuated so as to align the flanges 30, 31 with the stanchion. Coils 20*a* and 20*b* are actuated with a first electromagnetic force which is sufficient to hold the desired flange-to-stanchion alignment, but insufficient to form holding contact between the flange and stanchion. The bouyancy tank 12 is operated to provide positive or negative bouyancy to the chamber in combination with wire 13, or wire 13 may be taken up or payed out to effect a change of depth. With this mode of operation under the influence of the first force, the balls 27 of flange 20 are in sliding rotating contact with stanchion 19 whereas flange 20 is spaced from stanchion 19 as shown by space 40 in FIG. 2.

The attainment of the desired depth of the chamber is for positioning work tool 15, by way of example. A second electromagnetic force is provided to the coils 20*b* and 21*b* which second force is substantially greater than the first force. The second force causes a substantial attraction between flanges 20, 21 and stanchion 19 so that the flanges 20, 21 body 22, motor 35, housing 35*a* and arm portion 16*a* move towards the stanchion, with arm portion 16*a* extending from arm portion 16*b*. This outward movement continues for a distance equal to the spacing 40, until the flange surfaces 20*a*, 21*a* contact the stanchion surface.

With the contacting as foresaid, balls 27 are forced into sockets 26 by the stanchion surface, and springs 28 undergo compression in recesses 29. In this manner both flanges 20 and 21 are in a contacting non-sliding mode with respect to the stanchions, and consequently chamber 10 is held at the desired depth.

Figure 4:
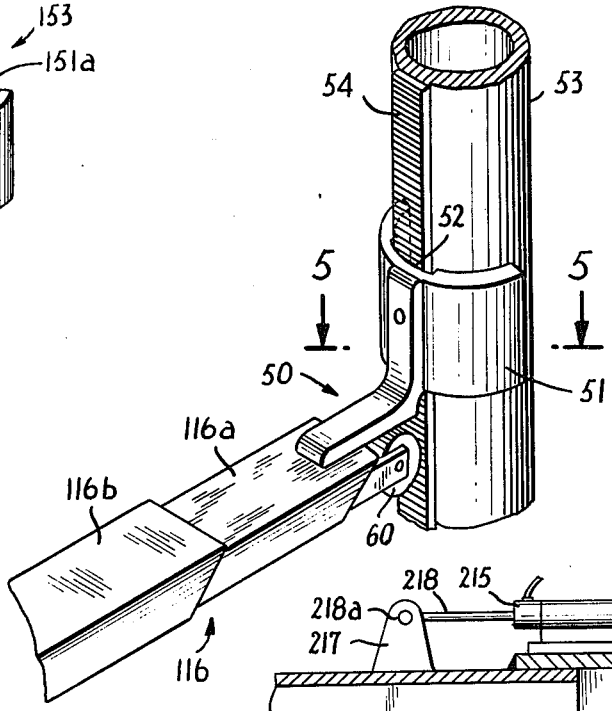
FIG. 4 is a rear perspective view of another clamp mechanism embodying the invention.
Figure 5:
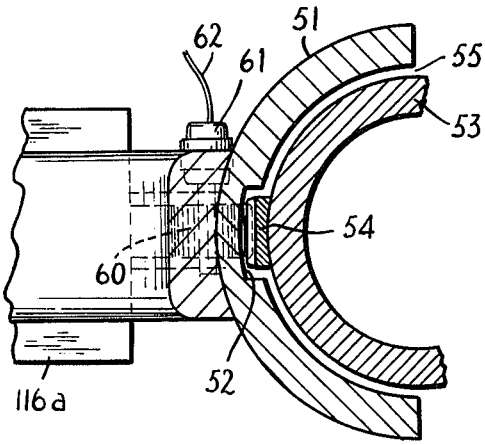
FIG. 5 is an enlarged sectional view taken along line 5—5 of FIG. 4.

Referring now to FIGS. 4 and 5, there is shown another embodiment of the invention namely clamp 50 comprising a semi-cylindrical electromagnetic flange 51 generally similar in design and construction to flange 20 but further comprising a longitudinal slot 52 for purposes hereinafter appearing. Flange 51 is formed with surface 51*a* for engaging the surface of stanchion 53. A gear rack 54 is mounted on stanchion 53, and flange slot 52 is oversized to accommodate rack 54. In the sliding mode there is clearance space, indicated as 55, between the flange and the stanchion.

Clamp 50 is mounted to retractably extensible arm portion 116*a* which is receivable in fixed arm portion 116*b* of arm 116, said elements 116, 116*a* and 116*b* being similar in design and construction to elements 16, 16*a* and 16*b* heretofore described.

A gear 60 is driven by motor 61 and the teeth of gear 60 enmesh with the teeth of stanchion gear rack 54. Drive motor 61 is connected to the chamber by electrical conduit 62 so that the motor may be operated remotely from within the chamber. Motor 61 and gear 60 may be resiliently mounted (not shown) with respect to the arm portion 116*a*.

In operation of the embodiment of FIGS. 4 and 5, a first electromagnetic force is applied and is of a sufficient force so that flange 51 is held to gear 60 in rack 54, and rack 54 is held in alignment in slot 52.

However the first electromagnetic force is insufficient to cause the closing of clearance 55 to effect contact between the flange and the stanchion.

Motor 61 has a reversing direction drive so that with one direction the gears 60 (on each guide arm of two arms) drive the guide arms and chamber upwardly, while in the reverse direction the gears 60 drive the guide arms and chamber downwardly. When the chamber attains the desired depth, motor 61 is shut off and a second electromagnetic force is applied to flange 51, causing a holding force between the flange and the stanchion. When the second force is sufficiently great, flange 51 contacts stanchion 53 and rack 54 resides in slot 52, with motor 61 and gear 60 resiliently seating in arm portion 116*a* to accommodate this closing of gap 55.

Figure 7:
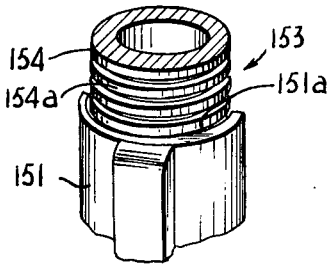
FIG. 7 is a perspective view of another embodiment similar to that of FIG. 4.

Referring now specifically to FIG. 7, there is shown an alternate form of the embodiment of FIGS. 4 and 5, namely in the latter embodiment stanchion 153 is formed with a 360° gear rack 154 and flange 151 is not provided with a slot, but in the fixedly held position, the flange surface 151*a* abuts the teeth 154*a* of rack 154. The remaining portion of this latter embodiment are shown in FIGS. 4 and 5 hereof.

Figure 6:
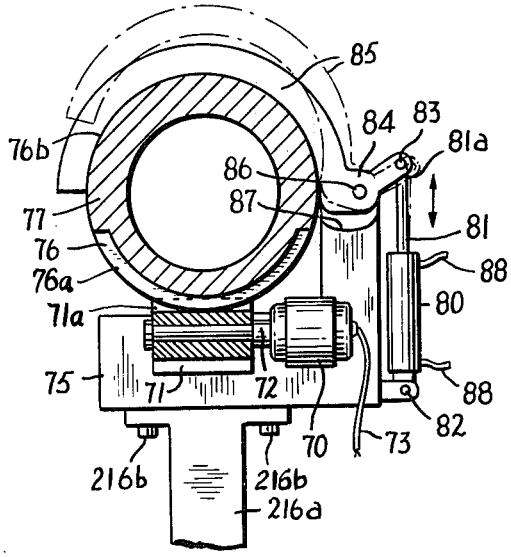
FIG. 6 is a sectional view similar to FIG. 5 but depicts an alternate embodiment of the invention.

Referring now to FIG. 6, there is another embodiment of the guide arm clamp mechanism comprising a drive motor 70 and gear 71 rotatably mounted on drive shaft 72. Motor 70 is electrically connected to the chamber by electrical conduit 73 so that the motor 70 may be operated remotely from within the chamber. Motor 70 is fixedly mounted to plate 75, and plate 75 is in turn mounted to retractably extensible guide arm portion 216*a* by means of bolts 216*b*. Guide arm portion 216*a* is similar in design and construction to portions 16*a* and 116*a* heretofore described and may be similar to that as shown and described in U.S. Pat. No. 3,851,491.

The teeth 71*a* of gear 71 enmesh with the teeth 76*a* of gear rack 76 formed directly in stanchion 77. Gear rack 76 is part-cylindrical in shape, the remaining part of the stanchion being a smooth part-cylindrical surface 76*b*.

A hydraulic cylinder 80 is having retractably extensible ram 81 is pivotally mounted at 82 to plate 75. The extended end 81*a* of ram 81 is pivotally mounted at 83 to lever arm portion 84 of clamp flange 85. Clamp flange 85 pivots on pin 86 with respect to plate 75 and a clearance groove 87 is provided to permit pivoted movement of flange 85.

In the sliding mode, wherein gear 71 drives the guide arm and chamber upwardly or downwardly to the desired depth, ram 81 is retracted and clamp flange 85 is spacedly disposed from stanchion surface 76*b*, as shown in the broken line configuration of FIG. 6. Once motor 70 has driven the chamber to the desired depth, cylinder 80 is remotely actuated through hydraulic lines 88, so as to extend ram 81, in turn causing the pivoting of flange 85 about pin 86 until flange 85 contacts surface 76*b* and clamps the arm to the stanchion, at the desired depth.

Figure 8:
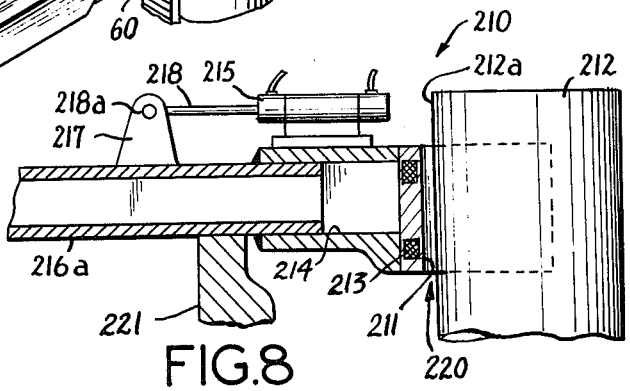
FIG. 8 is a sectional elevational view of an alternate embodiment of the top flange of the apparatus of FIG. 1.

Referring now to FIG. 8, there is shown an alternate embodiment of the top flange clamp. This latter embodiment is generally designated as 210. Clamp 210 comprises a flange 211 having a semi-cylindrical surface in facing opposition to the cylindrical surface 212*a* of stanchion 212. The electromagnetic elements 213 of this embodiment are similar in design and construction to that of flange 20 heretofore described.

In this latter embodiment guide arm extensible portion 216*a* slidably engages the inner housing 214 of flange 211. A hydraulic cylinder 215 with extensible rams 218 is connected to upright flange 217 which in turn is connected to guide arm portion 216*a.* In this manner of construction the retraction and extension of ram 218 in turn causes the sliding of flange 211 on arm 216*a,* away from and towards stanchion 212, respectively. This permits the flange to close gap 220 caused by the protruding balls (not shown in this latter embodiment) of the lower flange 221.

This latter embodiment is particularly useful to ensure positive contact of flange 211 with the stanchion without relying on the spring force acting in the lower flange. Further this latter embodiment is useful wherein the protruding balls of the lower flange are not resiliently mounted.

The stanchion accomodating the clamp of the present invention may in a broad sense by any guide bar fixedly supported at a submerged location adjacent a work area. In a preferred form the guide bar is a stanchion (or pair of stanchions) directly or indirectly fixedly mounted to the sea floor. The stanchions may be perpendicularly disposed to the sea floor but may also lie at any other angle to the sea floor.

Hydraulic power supply for the several hydraulic cylinder of the several assemblies, as previously discussed, is provided by a hydraulic pump housed within the chamber or outside the chamber. Electrical power supply is manually supplied from the surface station to the chamber by means of electrical power transmission lines.

From the foregoing it will be seen that this invention is one well adapted to attain all of the ends and objects hereinabove set forth, together with other advantages which are obvious and which are inherent in the mechanism.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A guide arm clamp for a submergible chamber comprising a flange, means to mount said flange to a work arm of the submergible chamber, said flange being formed so as to be engageable, when submerged, with a submerged, positioned guide bar, and means on said flange to permit sliding engagement with the guide bar in a first mode, and means on said flange to hold the clamp to the guide bar to prevent sliding in a second mode further comprising roller means mounted to the flange and extending away from the flange surface so as to contact the guide bar, means to retract the roller means in the second mode, whereby in the first mode the roller means slidingly engages the guide bar and in a second mode the flange contacts the guide bar.

2. The guide arm clamp of claim 1, said holding means comprises means mounted in said flange to provide an electromagnetic force between the flange and the guide bar, and said flange and guide bar being responsive to the electromagnetic force.

3. The guide arm clamp of claim 2, wherein the guide bar is a stanchion, wherein the guide arm clamp is movable transverse to the axis of the stanchion, so that in going from the first mode to the second mode the flange moves into contact with the stanchion.

4. The guide arm clamp of claim 1, said clamp being rotatable in relation to said work arm further comprising means mounted between said work arm and flange to rotate the clamp about an axis transverse to the axis of the guide bar.

5. The guide arm clamp of claim 1, wherein the roller means comprises a plurality of balls mounted in the flange, and wherein said means to retract comprises spring means disposed between the balls and the flange,

6. The guide arm clamp of claim 2, further comprises means to operably connect the electromagnetic force means to the submergible chamber, so that the electromagnetic force can be controlled from within the chamber.

7. The guide arm clamp of claim 1, wherein said flange has a radius of curvature so as to engage a complimentary radius of curvature of said guide bar.

8. The guide arm clamp of claim 7, wherein said flange is part cylindrical and wherein said guide bar is cylindrical in section.

9. The guide arm clamp of claim 5, wherein the balls are non-magnetic.

10. The guide arm clamp of claim 9, wherein the surface of said balls is Teflon.

11. A guide arm clamp for a submergible chamber comprising a flange, means to mount said flange to a work arm of a submergible chamber, said flange being formed so as to be engageable, when submerged, with a submerged, positioned guide bar, and means on said flange to permit movement along the guide bar, drive means comprising a gear mounted on said clamp and means to rotate the gear, said gear being engageable with a gear rack on said guide bar, whereby said driven gear provides movement of said clamp along said guide bar.

12. The guide arm clamp of claim 11, means to pivot said flange to said clamp, and wherein said first mode the flange is pivoted to a first position to permit sliding engagement with the guide bar, and wherein said second mode the flange is pivoted to a second position to contact said guide bar.

13. The guide arm clamp of claim 12, said clamp further comprising drive means to move the clamp along the guide bar.

14. The guide arm clamp of claim 12, wherein said means to pivot comprises a cylinder with a retractably extensible ram and wherein the outward end of the ram is connected to the flange.

15. The guide arm clamp of claim 11, said drive means further comprising a gear mounted on said clamp and means to rotate the gear, said gear being engageable with a gear rack on said guide bar.

16. A guide arm clamp for a submergible chamber comprising a flange, means to mount said flange to a work arm of a submergible chamber, said flange being formed so as to slidably engage a submerged positioned guide bar, means operatively mounted with said clamp and work arm to move said clamp relative to said work arm, whereby in a first mode said flange is spaced from and in sliding engagement with said guide bar and in said second mode said clamp movement means causes said flange to contact said guide bar, means mounted in said flange to provide an electromagnetic force between the flange and the guide bar, said flange and guide bar being responsive to the electromagnetic force, whereby the flange is held to the guide bar in said second mode.

* * * * *